US011195686B2

(12) United States Patent
Yang et al.

(10) Patent No.: US 11,195,686 B2
(45) Date of Patent: Dec. 7, 2021

(54) THERMIONIC EMISSION DEVICE AND METHOD FOR MAKING THE SAME

(71) Applicants: Tsinghua University, Beijing (CN); HON HAI PRECISION INDUSTRY CO., LTD., New Taipei (TW)

(72) Inventors: Xin-He Yang, Beijing (CN); Peng Liu, Beijing (CN); Kai-Li Jiang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/067,734

(22) Filed: Oct. 11, 2020

(65) Prior Publication Data

US 2021/0217572 A1 Jul. 15, 2021

(30) Foreign Application Priority Data

Jan. 15, 2020 (CN) ..... 202010044329.3

(51) Int. Cl.

| | |
|---|---|
| ***H01J 9/04*** | (2006.01) |
| ***H01J 1/144*** | (2006.01) |
| ***H01J 1/146*** | (2006.01) |
| ***H01J 1/304*** | (2006.01) |

(52) U.S. Cl.

CPC ..... *H01J 9/042* (2013.01); *H01J 1/144* (2013.01); *H01J 1/146* (2013.01); *H01J 1/304* (2013.01); *H01J 2201/30469* (2013.01)

(58) Field of Classification Search

None

See application file for complete search history.

(56) References Cited

U.S. PATENT DOCUMENTS

| | | | | |
|---|---|---|---|---|
| 7,736,741 | B2 | 6/2010 | Maruyama et al. | |
| 8,803,410 | B2 | 8/2014 | Liu et al. | |
| 10,483,400 | B2 | 11/2019 | Wang et al. | |
| 2003/0001477 | A1* | 1/2003 | Sasaguri ..... | H01J 3/022 313/310 |
| 2006/0214192 | A1 | 9/2006 | Nanai et al. | |
| 2007/0155064 | A1 | 7/2007 | Chen et al. | |
| 2009/0181239 | A1 | 7/2009 | Fan et al. | |

FOREIGN PATENT DOCUMENTS

| | | |
|---|---|---|
| CN | 101170130 | 4/2008 |
| TW | 200729354 | 8/2007 |
| TW | I476147 | 3/2015 |
| TW | I581664 | 5/2017 |
| TW | I664736 | 7/2019 |

* cited by examiner

*Primary Examiner* — Ashok Patel

(74) *Attorney, Agent, or Firm* — ScienBiziP, P.C.

(57) ABSTRACT

A thermionic emission device comprises a first electrode, a second electrode, a single carbon nanotube, an insulating layer and a gate electrode. The gate electrode is located on a first surface of the insulating layer. The first electrode and the second electrode are located on a second surface of the insulating layer and spaced apart from each other. The carbon nanotube comprises a first end, a second end opposite to the first end, and a middle portion located between the first end and the second end. The first end of the carbon nanotube is electrically connected to the first electrode, and the second end of the carbon nanotube is electrically connected to the second electrode.

16 Claims, 9 Drawing Sheets

THERMIONIC EMISSION DEVICE AND METHOD FOR MAKING THE SAME

CROSS-REFERENCE TO RELATED APPLICATIONS

This application claims all benefits accruing under 35 U.S.C. § 119 from China Patent Application No. 202010044329.3, filed on Jan. 15, 2020, in the China National Intellectual Property Administration, the contents of which are hereby incorporated by reference. The application is also related to co-pending applications entitled, "FIELD EFFECT TRANSISTOR AND METHOD FOR MAKING THE SAME", filed Oct. 11, 2020.

FIELD

The present disclosure relates to a thermionic emission device.

BACKGROUND

Electron emission refers to a phenomenon that electrons in a material obtain energy to overcome a restraint of a potential barrier and are emitted to the vacuum. According to a way that electrons obtain the energy and overcome their work function, electron emission can be divided into thermionic emission, field electron emission, photoelectron emission, and secondary electron emission. Thermionic emission is the use of heating to increase the kinetic energy of electrons inside the emitter, so that the kinetic energy of a part of the electrons is large enough to overcome a surface barrier of the emitter and escape outside the emitter. In the prior art, a thermal emission current of a thermal emission electronic device is controlled by a bias voltage and increases with the increase of the bias voltage. However, the thermal emission current will reach saturation when the thermal emission current is increased to a certain extent, which cannot meet the requirement of larger current density and higher brightness.

BRIEF DESCRIPTION OF THE DRAWINGS

Implementations of the present technology will now be described, by way of example only, with reference to the attached figures.

DETAILED DESCRIPTION

Figure 1:
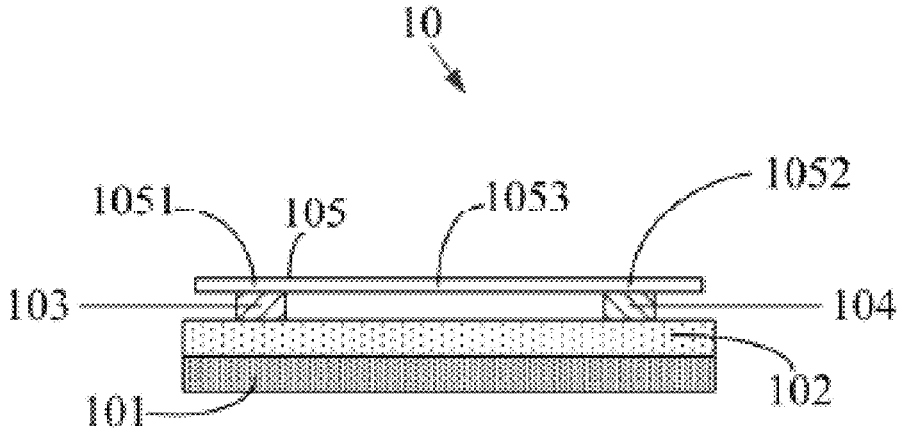
FIG. 1 is a view of the first embodiment of a thermionic emission device according to one example.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one".

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts can be exaggerated to illustrate details and features of the present disclosure better.

Several definitions that apply throughout this disclosure will now be presented.

The term "comprise" or "comprising" when utilized, means "include or including, but not necessarily limited to"; it specifically indicates open-ended inclusion or membership in the so-described combination, group, series, and the like.

Referring to FIG. 1, a thermionic emission device 10 is provided according to a first embodiment. The thermionic emission device 10 comprises a first electrode 103, a second electrode 104, a single carbon nanotube 105, an insulating layer 102 and a gate electrode 101. The gate electrode 101 is insulated from the first electrode 103, the second electrode 104, and the single carbon nanotube 105 through the insulating layer 102. The first electrode 103 and the second electrode 104 are spaced apart from each other. The single carbon nanotube 105 comprises a first end 1051, a second end 1052 opposite to the first end 1051, and a middle portion 1053 located between the first end 1051 and the second end 1052. The first end 1051 of the single carbon nanotube 105 is electrically connected to the first electrode 103, and the second end 1052 of the single carbon nanotube 105 is electrically connected to the second electrode 104.

The gate electrode 101 can be a free-standing layered structure or a thin film disposed on a surface of an insulating substrate. A thickness of the gate electrode 101 is not limited. In one embodiment, a thickness of the gate electrode 101 is ranged from about 0.5 nanometers to about 100 microns. A material of the gate electrode 101 can be metal, alloy, heavily doped semiconductor (such as silicon), indium tin oxide (ITO), antimony tin oxide (ATO), conductive silver glue, conductive polymer or conductive carbon nanotubes. The metal or alloy material can be aluminum (Al), copper (Cu), tungsten (W), molybdenum (Mo), gold (Au), titanium (Ti), palladium (Ba) or any combination thereof. The material of the gate electrode 101 can be selected from high temperature-resistant materials. In one embodiment, the gate electrode 101 is a copper foil with a thickness of about 50 nanometers.

The insulating layer 102 is located on a surface of the gate electrode 101. The insulating layer 102 is a continuous layered structure. The insulating layer 102 is used as a support layer. A material of the insulating layer 102 is an insulating material, can be hard materials or flexible materials. The hard materials can be glass, quartz, ceramics, diamond, silicon wafers. The flexible materials can be plastics or resins. In one embodiment, the insulating layer 102 is made of high temperature-resistant material. In one embodiment, the insulating layer 102 is a silicon wafer with a silicon dioxide layer.

The first electrode 103 and the second electrode 104 are both made of conductive material. The conductive material can be selected from metal, ITO, ATO, conductive silver glue, conductive polymer, conductive carbon nanotube, and the like. The metal material can be aluminum (Al), copper (Cu), tungsten (W), molybdenum (Mo), gold (Au), titanium (Ti), palladium (Ba) or any combination thereof. In one embodiment, the first electrode 103 and the second electrode 104 are made of high temperature-resistant materials. The first electrode 103 and the second electrode 104 can be a conductive film. In one embodiment, the first electrode 103 and the second electrode 104 are respectively a metal titanium film, and a thickness of the metal titanium film is about 50 nanometers.

The single carbon nanotube 105 can be directly fixed on surfaces of the first electrode 103 and the second electrode 104 by its own adhesiveness. In other embodiments, the single carbon nanotube 105 can also be fixed on the surfaces of the first electrode 103 and the second electrode 104 by a conductive adhesive.

The single carbon nanotube 105 can be a single-wall carbon nanotube, a double-wall carbon nanotube or a multi-wall carbon nanotube. The single carbon nanotube 105 can have no defects or the middle portion 1053 of the single carbon nanotube 105 can have defects. Various methods can be used to form defects in the middle portion 1053 of the single carbon nanotube 105. In one embodiment, a voltage can be applied to both ends of the carbon nanotubes 105 in a vacuum environment, and the carbon nanotubes 105 are energized to generate heat. Since the two ends of the carbon nanotubes 105 are directly in contact with external electrodes, and a heat generated by energizing both ends of the carbon nanotubes is dissipated through the external electrodes, so a temperature of the middle portion 1053 of the single carbon nanotube 105 is higher than that of the two ends. A carbon element on a wall of the middle portion 1053 is vaporized at a high temperature, and a seven-membered ring or an eight-membered ring of carbon atoms can be formed on a wall of the single carbon nanotube 105. Thus, defects are formed on the wall of the single carbon nanotube 105. In one embodiment, defects in the middle portion 1053 of the single carbon nanotube 105 are formed by the plasma etching method. In order to easily form defects in the middle portion 1053 of the single carbon nanotube 105, the single carbon nanotube 105 is preferably the single-wall carbon nanotube or the double-wall carbon nanotube. Since the multi-walled carbon nanotube comprises a large number of walls and a large number of conductive channels, it is relatively difficult to control a temperature to produce defects in the multi-walled carbon nanotube because that the multi-walled carbon nanotube is easily burnt into two sections at a high temperature. There are fewer conductive channels in the single-wall carbon nanotube or the double-wall carbon nanotube, so once defects are generated at a high temperature, it will directly affect the electrical properties of the single-wall carbon nanotube or the double-wall carbon nanotube.

Referring to FIG. 1, in one embodiment, the first electrode 103 and the second electrode 104 are located on the surface of the insulating layer 102 and spaced apart from each other. The first end 1051 of the single carbon nanotube 105 is located on the surface of the first electrode 103, and the second end 1052 of the single carbon nanotube 105 is located on the surface of the second electrode 104. That is, the first electrode 103 and the second electrode 104 are located between the insulating layer 102 and the single carbon nanotube 105, and the single carbon nanotube 105 is suspended above the insulating layer 102 by the first electrode 103 and the second electrode 104. In one embodiment, the first electrode 103 and the second electrode 104 are directly in contact with the insulating layer 102 and the single carbon nanotube 105.

Figure 2:
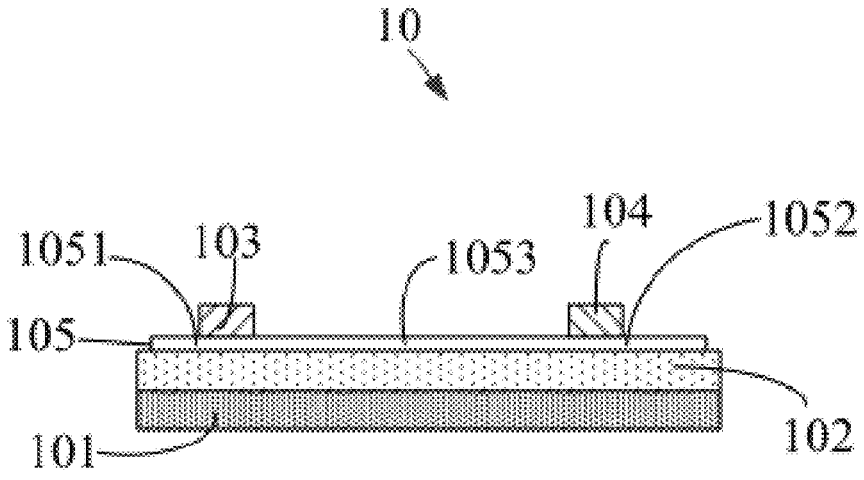
FIG. 2 is a view of the first embodiment of a thermionic emission device according to another embodiment.

Referring to FIG. 2, in one embodiment, the single carbon nanotube 105 is directly in contact with the surface of the insulating layer 102. The first electrode 103 is located on the first end 1051 of the single carbon nanotube 105, and the second electrode 104 is located on the second end 1052 of the single carbon nanotube 105. That is, the first end 1051 of the single carbon nanotube 105 is located between the insulating layer 102 and the first electrode 103, and the second end 1052 of the single carbon nanotube 105 is located between the insulating layer 102 and the second electrode 104. The middle portion 1053 of the carbon nanotubes 105 can be suspended above the insulating layer 102, or supported by the insulating layer 102. In order to avoid the heat generated by the carbon nanotubes 105 from damaging the insulating layer 102 or transferring to the insulating layer 102 during operation, the middle portion 1053 of the single carbon nanotube 105 is preferably suspended.

In one embodiment, a low work function layer can be formed on the surface of the single carbon nanotube 105, and a material of the low work function layer can be barium oxide or thorium, etc., so that the thermionic emission device 10 can realize thermionic electron emission at a lower temperature.

Figure 3:
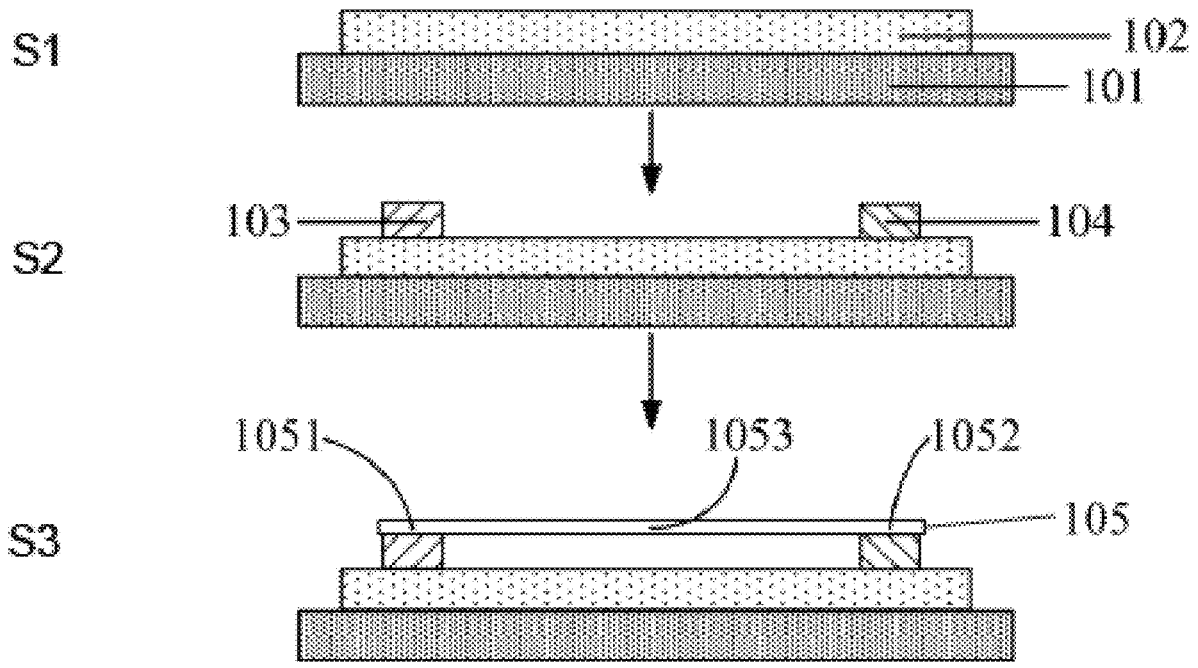
FIG. 3 is a flowchart of one embodiment of a method for making the thermionic emission device.

FIG. 3 illustrates a method of one embodiment of making the thermionic emission device 10, the method comprises:

S1, providing a gate electrode 101, and forming an insulating layer 102 on a surface of the gate electrode 101;

S2, forming a first electrode 103 and a second electrode 104 on a surface of the insulating layer 102 away from the gate electrode 101, wherein the first electrode 103 and the second electrode 104 are spaced apart from each other; and S3, locating a single carbon nanotube 105 on the first electrode 103 and the second electrode 104, wherein the single carbon nanotube 105 comprises a first end 1051, a second end 1052 opposite to the first end 1051, and a middle portion 1053 located between the first end 1051 and the second end 1052, the first end 1051 of the single carbon nanotube 105 is electrically connected to the first electrode 103, and the second end 1052 of the single carbon nanotube 105 is electrically connected to the second electrode 104.

Before step S1, an insulating substrate can be provided, and then the gate electrode 101 can be formed on the insulating substrate. Methods for forming the gate electrode 101, the insulating layer 102, the first electrode 103, and the second electrode 104 are not limited and can be formed by photolithography, magnetron sputtering, evaporation, and the like.

In step S3, the single carbon nanotube 105 can be prepared by a chemical vapor deposition method or a physical vapor deposition method. In one embodiment, according to the "kite flying mechanism", the chemical vapor deposition method is used to grow an ultra-long carbon nanotube. The method of growing the ultra-long carbon nanotube comprises the following substeps: (a) a growth substrate and a receiving substrate are provided, and a monodisperse catalyst is formed on a surface of the growth substrate; (b) a carbon source gas is introduced; (c) the nanotubes grow and float in a direction of an airflow, and finally fall on a surface of the receiving substrate. About a growth method of the ultra-long carbon nanotube, please refer to the Chinese Patent Application No. 200810066048.7 filed by Shoushan Fan et al. on Feb. 1, 2008. In order to save space, a detailed description is omitted here, but all the technical disclosures of the above-mentioned application should also be regarded as part of the technical disclosure of the present invention.

In one embodiment, after the single carbon nanotube 105 is prepared, the single carbon nanotube 105 can be directly transferred to surfaces of a first electrode 103 and a second electrode 104. In another embodiment, when the single carbon nanotube 105 is a double-wall carbon nanotube or a multi-wall carbon nanotube, an outer wall of the single carbon nanotube 105 can be removed first to obtain an inner layer of the single carbon nanotube 105, and then the inner layer of the single carbon nanotube 105 is transferred to the surfaces of the first electrode 103 and the second electrode 104. The inner layer of the single carbon nanotube 105 is super clean, which is conducive to an adhesion of the single carbon nanotube 105 to the first electrode 103 and the second electrode 104.

The method for locating the single carbon nanotube 105 on the first electrode 103 and the second electrode 104 is not limited. In one embodiment, the method for transferring the single carbon nanotube 105 comprises the following steps:

Step 31, making the single carbon nanotube 105 to be observed under an optical microscope;

Step 32, providing two tungsten needle tips, and clipping the single carbon nanotube 105 with the two tungsten needle tips;

Step 33, transferring the single carbon nanotube 105 to a target position via the two tungsten needle tips.

In step 31, since a diameter of the single carbon nanotube 105 is only a few nanometers or tens of nanometers, the single carbon nanotube 105 cannot be observed under an optical microscope, but can only be observed under a scanning electron microscope, a transmission electron microscope, etc. In order to observe the single carbon nanotube 105 under the optical microscope, a plurality of nanoparticles are formed on a surface of the single carbon nanotube 105. The plurality of nanoparticles can scatter light. Thus, the single carbon nanotube 105 with nanoparticles can be observed under the optical microscope. The material of the plurality of nanoparticles is not limited. The plurality of nanoparticles can be titanium dioxide ($TiO_2$) nanoparticles, sulfur (S) nanoparticles, and the like.

In step 32, two tungsten needle tips are provided. Under the optical microscope, one of the two tungsten needle tips lightly touches one end of the single carbon nanotube 105, and the single carbon nanotube 105 will gently adhere to the tungsten needle tip under a van der Waals force. The single carbon nanotube 105 is gently dragged by the tungsten needle tip, and the outer wall of the single carbon nanotube 105 is broken under an external force. Since the inner layer and the outer wall of the single carbon nanotube 105 are super lubricated, the inner layer of the single carbon nanotube 105 can be extracted from the single carbon nanotube 105. Since the plurality of nanoparticles are coated on the outer wall of the single carbon nanotube 105, a position of the inner layer can be roughly inferred. When the inner layer is extracted to a required length, another tungsten needle is used to cut the other end of the single carbon nanotube 105. Thus, the single carbon nanotube 105 is transferred and adsorbed between the two tungsten needle tips.

In step 33, under the optical microscope, the two tungsten needle tips is gently moved, the carbon nanotube 105 is moved with a movement of the two tungsten needle tips. One end of the single carbon nanotube 105 is located on the surface of the first electrode 103 and is directly in contact with the first electrode 103. The other end of the single carbon nanotube 105 is located on the surface of the second electrode 104 and is directly in contact with the second electrode 104.

The order of step S2 and step S3 can be exchanged. That is, the single carbon nanotube 105 can be transferred to the surface of the insulating layer 102 first, so that the single carbon nanotube 105 is directly in contact with the insulating layer 102. The first electrode 103 is located on the first end 1051, and the second electrode 104 is located on the second end 1052.

After step 3, a step of forming defects in the middle portion 1053 of the single carbon nanotube 105 can be comprised. The method of forming defects in the middle portion 1053 of the single carbon nanotube 105 is not limited. Specifically, the method can be applying a voltage to both ends of the single carbon nanotube 105, irradiating the middle portion 1053 of the single carbon nanotube 105 with laser or electromagnetic waves, etching the middle portion 1053 of the single carbon nanotube 105 with plasma, and so on. In the above method, parameters, such as a size of an applied voltage, a time of applying the voltage, a laser power, a time of laser irradiation, etc., are not determined. The parameters are related to diameter, length, number of walls of the single carbon nanotube 105 with defects. In one embodiment, when the single carbon nanotube 105 is the single-walled carbon nanotubes, the applied voltage can be 1.5V-2.5V, and when the single carbon nanotube 105 is the double-walled carbon nanotube, the applied voltage can be 2V-3V.

Figure 4:
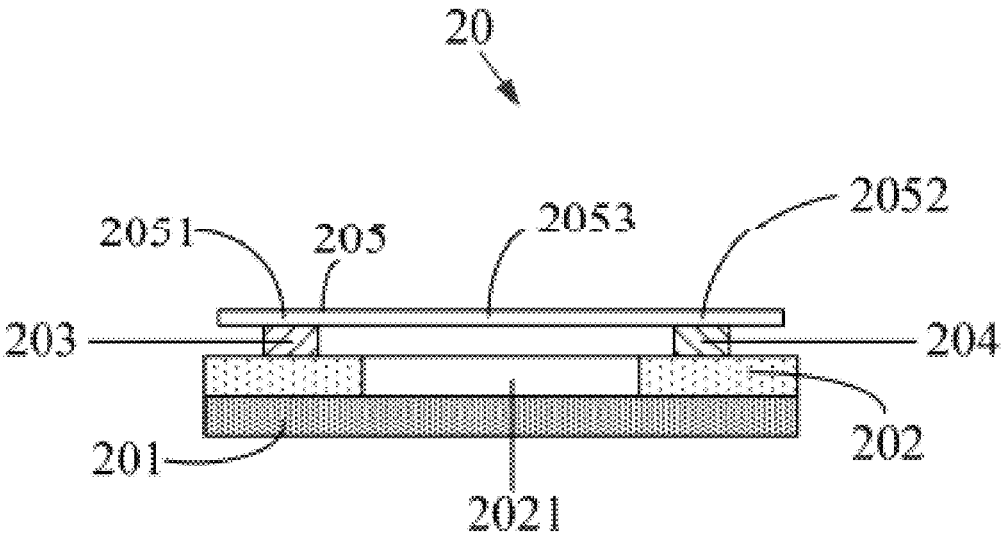
FIG. 4 is a view of the second embodiment of the thermionic emission device according to one example.

Referring to FIG. 4, a thermionic emission device 20 is provided in a second embodiment. The thermionic emission device 20 comprises a gate electrode 201, an insulating layer 202, a first electrode 203, a second electrode 204, and a single carbon nanotube 205. The structure of the thermionic emission device 20 is basically the same as the thermionic emission device 10. The difference is that the insulating layer 202 has a hole 2021 in the thermionic emission device 20. The hole 2021 can be a through hole or a blind hole.

Figure 5:
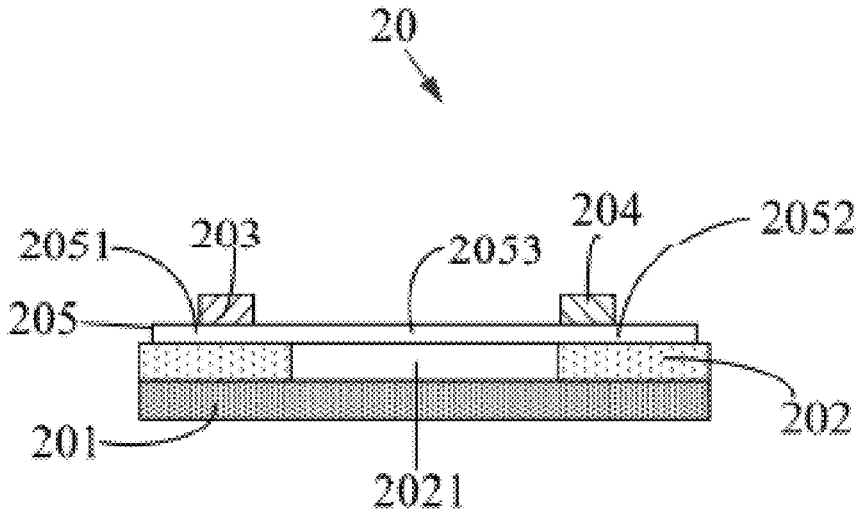
FIG. 5 a view of the second embodiment of the thermionic emission device according to another example.

In one embodiment, referring to FIG. 4, the first electrode 203 and the second electrode 204 are respectively located on both sides of the hole 2021 of the insulating layer 202. The first end 2051 of the carbon nanotube 205 is located on a surface of the first electrode 203, and the second end 2052 of the carbon nanotube 205 is located on a surface of the second electrode 204. The middle portion 2053 of the carbon nanotube 205 is suspended above the hole 2021 of the insulating layer 202. In another embodiment, referring to FIG. 5, the carbon nanotube 205 is directly in contact with the insulating layer 202, the two ends of the carbon nanotube 205 are respectively located on both sides of the hole 2021, and the middle portion 2053 of the carbon nanotube 205 is suspended above the hole 2021. The first end 2051 of the carbon nanotube 205 is located between the insulating layer 202 and the first electrode 203, and the second end 2052 of the carbon nanotube 205 is located between the insulating layer 202 and the second electrode 204.

The materials of the gate electrode 201, the insulating layer 202, the first electrode 203, and the second electrode 204 are respectively the same as those of the gate electrode 101, the insulating layer 102, the first electrode 103 and the second electrode 104.

Figure 6:
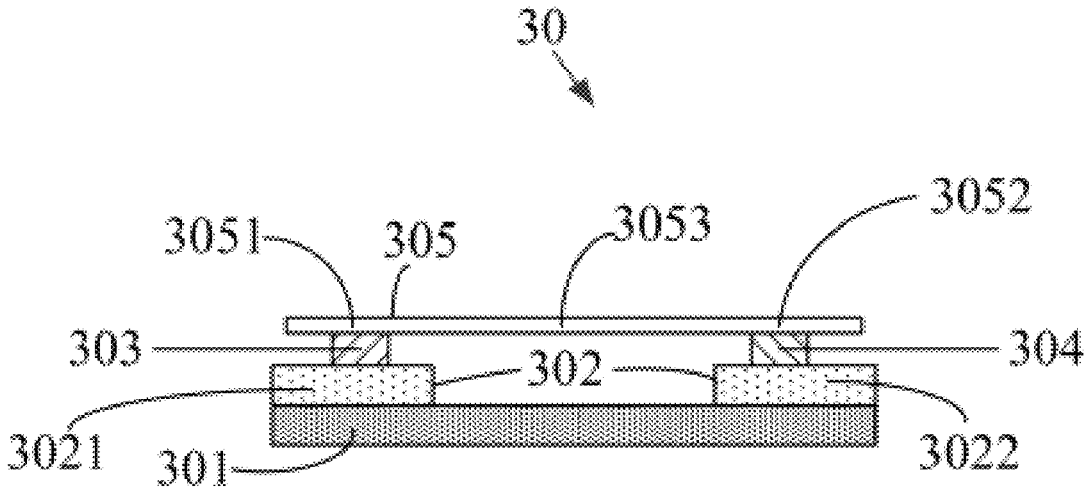
FIG. 6 is a view of third embodiment of the thermionic emission device according to one example.

Referring to FIG. 6, a thermionic emission device 30 is provided in a third embodiment. The thermionic emission device 30 comprises a gate electrode 301, an insulating layer 302, a first electrode 303, a second electrode 304 and a single carbon nanotube 305. The structure of the thermionic emission device 30 is basically the same as the thermionic emission device 20. The difference is that the insulating layer 302 comprises a first insulating layer 3021 and a second insulating layer 3022, and the first insulating layer 3021 and the second insulating layer 3022 are spaced apart from each other and located on a surface of the gate electrode 301.

Figure 7:
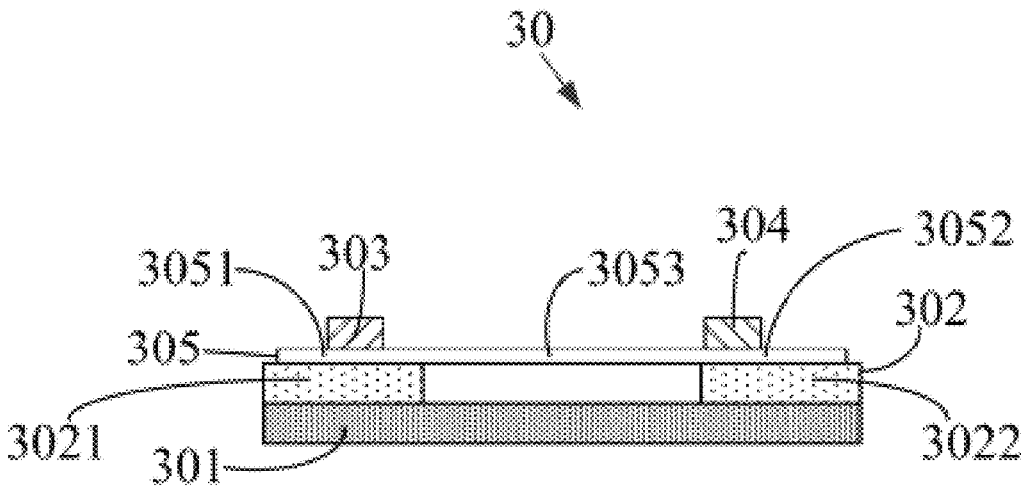
FIG. 7 a view of the third embodiment of the thermionic emission device according to another example.

In one embodiment, referring to FIG. 6, the first electrode 303 is located on a surface of the first insulating layer 3021, and the second electrode 304 is located on a surface of the second insulating layer 3022. The first end 3051 of the carbon nanotube 305 is located on a surface of the first electrode 303, the second end 3051 of the carbon nanotube 305 is located on a surface of the second electrode 304, and the middle portion 3053 of the carbon nanotube 305 is suspended between the first electrode 303 and the second electrode 304. In another embodiment, referring to FIG. 7, the first end 3051 of the carbon nanotube 305 is located between and directly in contact with the first insulating layer 3021 and the first electrode 303. The second end 3052 of the carbon nanotube 305 is located between and directly in contact with the second insulating layer 3022 and the second electrode 304. The middle portion 3053 of the carbon nanotube 305 is suspended between the first insulating layer 3021 and the second insulating layer 3022.

The materials of the gate electrode 301, the insulating layer 302, the first electrode 303, and the second electrode 304 are respectively the same as those of the gate electrode 101, the insulating layer 102, the first electrode 103 and the second electrode 104.

Figure 8:
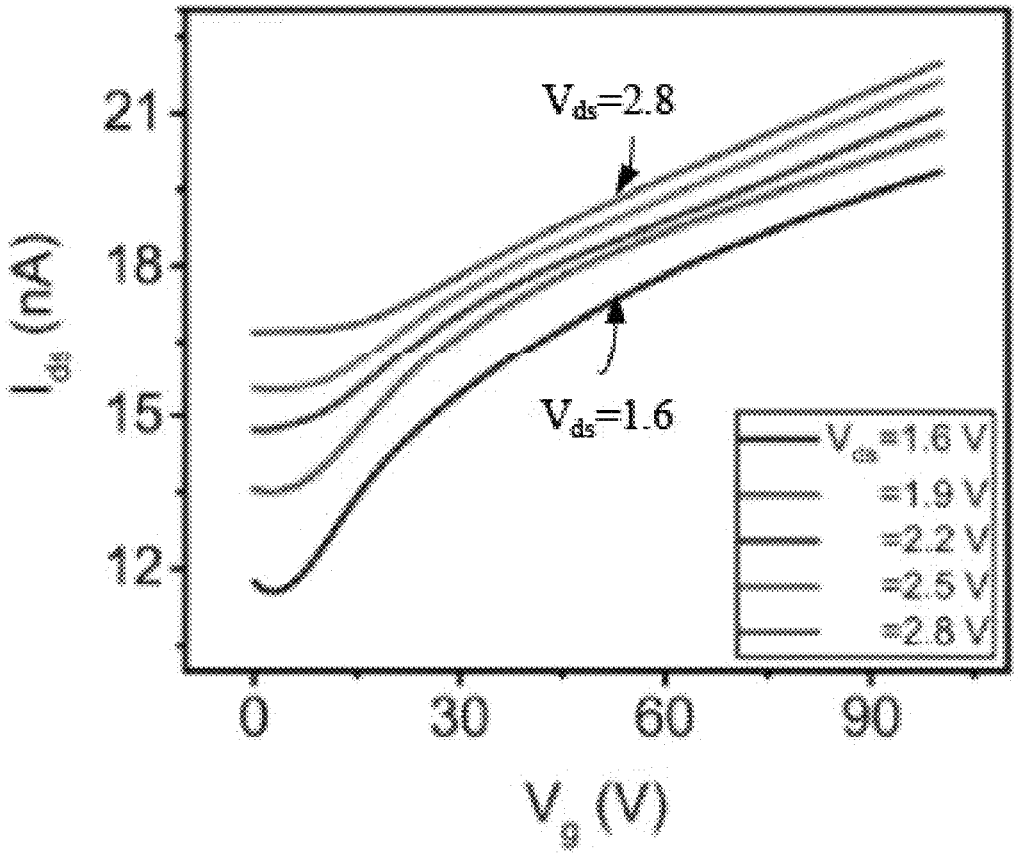
FIG. 8 is a graph showing a relationship between a bias current and a grid voltage of a carbon nanotube.
Figure 9:
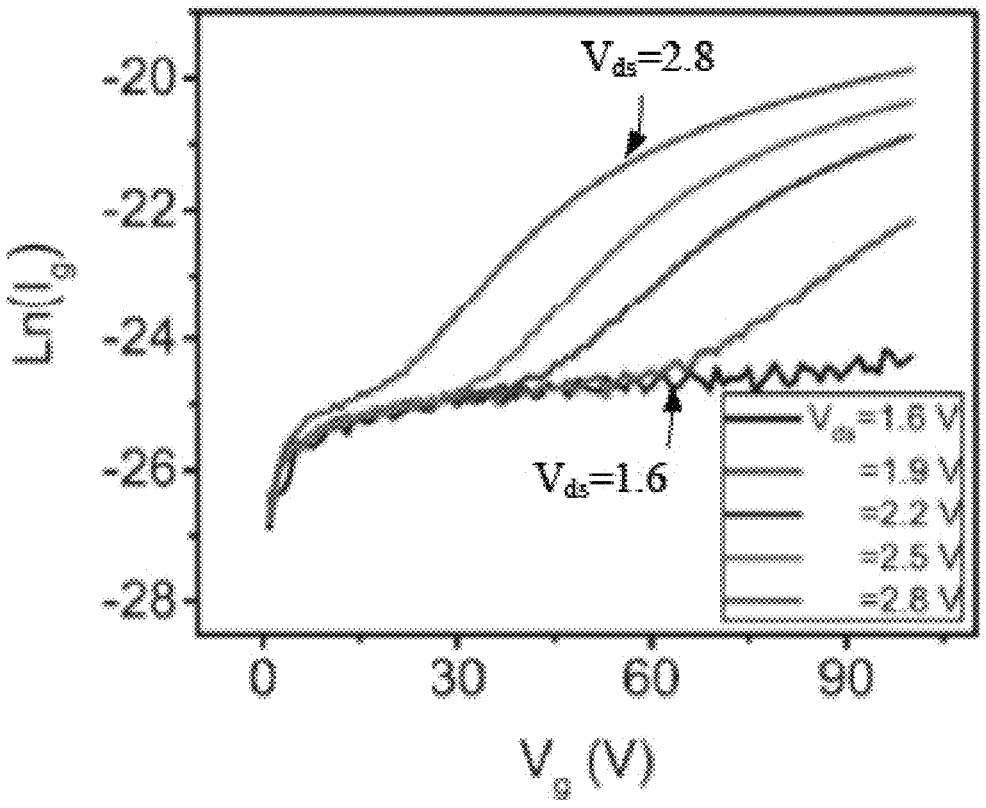
FIG. 9 is a graph showing a relationship between a thermal emission current and the grid voltage of the carbon nanotube.

The following test experiments all use the thermionic emission device 30. Referring to FIG. 8 and FIG. 9, a certain bias voltage is applied between the first electrode 303 and the second electrode 304, and a voltage is applied to the gate electrode 301. The voltage is represented by a symbol Vg. Under an action of the gate electrode voltage, a bias current of the carbon nanotube 305 exhibits bipolar characteristics, that is, when the gate electrode voltage is negative or positive, the bias current is relatively large, and the bias current is relatively small when the gate electrode voltage is close to 0 V. The bias current is a current flowing through the carbon nanotube 305 and is represented by a symbol Ids. A thermal emission current is represented by a symbol Ig. When the gate electrode voltage is 0, the thermal emission current can not be detected due to a small bias voltage. The carbon nanotube 305 can generate enough heat as the gate electrode voltage increases, so that a kinetic energy of a part of electrons is large enough to overcome a surface barrier of the carbon nanotube 305, and electrons can escape from the body to realize an emission of thermal electrons. The bias current and the thermal emission current of the carbon nanotube 305 increase with an increase of the gate electrode voltage. Compared with conventional thermionic emission, the thermal electron emission controlled by the grid exhibits an unsaturated effect.

The gate electrode 301 can control the bias current flowing through the carbon nanotube 305. Under a certain bias voltage, a heating power of the carbon nanotube 305 increases with an increase of the bias current. The heating power is a product of the bias voltage and the bias current. An intensity of thermionic emission is enhanced with an increase in the temperature of the carbon nanotube 305.

The thermionic emission device provided by the present invention has the following advantages: first, a grid is additionally provided, and the thermionic emission current and the bias current can be enhanced by a control of the grid; second, under certain bias conditions, the thermal emission current increases with the increase of the grid voltage, and the thermionic emission will not tend to be saturated, which is beneficial to meet the needs of greater current density and higher brightness; third, under the control of the gate electrode, when the bias voltage between the first electrode and the second electrode is low, the thermionic emission device can also emit thermionic electrons; fourth, the use of carbon nanotube as thermionic electron emitters can further reduce the size of the thermionic emission device.

Even though numerous characteristics and advantages of certain inventive embodiments have been set out in the foregoing description, together with details of the structures and functions of the embodiments, the disclosure is illustrative only. Changes can be made in detail, especially in matters of an arrangement of parts, within the principles of the present disclosure to the full extent indicated by the broad general meaning of the terms in which the appended claims are expressed.

Depending on the embodiment, certain of the steps of methods described can be removed, others can be added, and the sequence of steps can be altered. It is also to be understood that the description and the claims drawn to a method can comprise some indication in reference to certain steps. However, the indication used is only to be viewed for identification purposes and not as a suggestion as to an order for the steps.

The embodiments shown and described above are only examples. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure up to, and including the full extent established by the broad general meaning of the terms used in the claims. It will, therefore, be appreciated that the embodiments described above can be modified within the scope of the claims.

What is claimed is:

1. A thermionic emission device comprising:

an insulating layer comprising a first surface and a second surface opposite to the first surface;

a gate electrode located on the first surface of the insulating layer;

a first electrode and a second electrode located on the second surface of the insulating layer and spaced apart from each other; and a single carbon nanotube comprising a first end, a second end opposite with the first end, and a middle portion located between the first end and the second end; wherein the first end of the single carbon nanotube is electrically connected with the first electrode, and the second end of the single carbon nanotube is electrically connected with the second electrode, and the single carbon nanotube is suspended above the insulating layer from the first electrode and the second electrode, wherein the single carbon nanotube generates heat as the gate electrode voltage increases, a kinetic energy of a part of electrons is large enough to overcome a surface barrier of the single carbon nanotube, and the part of electrons escape from a body of the single carbon nanotube to emit thermal electrons.

2. The thermionic emission device of claim 1, wherein the middle portion of the carbon nanotube comprises defects.

3. The thermionic emission device of claim 2, wherein the middle portion of the carbon nanotube comprises a seven-membered ring or an eight-membered ring.

4. The thermionic emission device of claim 1, wherein the single carbon nanotube is a single-wall carbon nanotube or a double-wall carbon nanotube.

5. The thermionic emission device of claim 1, wherein the insulating layer comprises a through hole or a blind hole.

6. The thermionic emission device of claim 5, wherein the first electrode and the second electrode are respectively located on both sides of the hole of the insulating layer.

7. The thermionic emission device of claim 1, wherein the insulating layer comprises a first insulating layer and a second insulating layer, and the first insulating layer and the second insulating layer are spaced apart from each other and located on a surface of the gate electrode.

8. The thermionic emission device of claim 7, wherein the first electrode is located on a surface of the first insulating layer, and the second electrode is located on a surface of the second insulating layer.

9. A thermionic emission device comprising:

an insulating layer comprising a first surface and a second surface opposite to the first surface;

a gate electrode located on the first surface of the insulating layer;

a single carbon nanotube located on the second surface of the insulating layer and comprising a first end, a second end opposite to the first end, and a middle portion located between the first end and the second end; and a first electrode and a second electrode, wherein the first electrode is located on and electrically connected to the first end of the single carbon nanotube, and the second electrode is located on and electrically connected to the second end of the single carbon nanotube, wherein the single carbon nanotube generates heat as the gate electrode voltage increases, a kinetic energy of a part of electrons is large enough to overcome a surface barrier of the single carbon nanotube, and the part of electrons escape from a body of the single carbon nanotube to emit thermal electrons.

10. The thermionic emission device of claim 9, wherein the insulating layer comprises a through hole or a blind hole.

11. The thermionic emission device of claim 9, wherein the middle portion of the carbon nanotube comprises defects.

12. The thermionic emission device of claim 11, wherein the middle portion of the carbon nanotube comprises a seven-membered ring or an eight-membered ring.

13. The thermionic emission device of claim 9, wherein the single carbon nanotube is a single-wall carbon nanotube or a double-wall carbon nanotube.

14. The thermionic emission device of claim 9, wherein the insulating layer comprises a first insulating layer and a second insulating layer, and the first insulating layer and the second insulating layer are spaced apart from each other.

15. The thermionic emission device of claim 10, wherein the single carbon nanotube carbon nanotube is directly in contact with the insulating layer, the first end and the second end of the single carbon nanotube are respectively located on both sides of the hole, and the middle portion of the single carbon nanotube is suspended above the hole.

16. The thermionic emission device of claim 15, wherein the first end of the single carbon nanotube is located between the insulating layer and the first electrode, and the second end of the single carbon nanotube is located between the insulating layer and the second electrode.

* * * * *